US007213704B2

(12) United States Patent
Li Vigni et al.

(10) Patent No.: US 7,213,704 B2
(45) Date of Patent: May 8, 2007

(54) PACK OF RIGID TYPE FOR TOBACCO PRODUCTS

(75) Inventors: Angelo Li Vigni, Bologna (IT); Fiorenzo Draghetti, Medicina (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 10/470,130

(22) PCT Filed: Jan. 25, 2002

(86) PCT No.: PCT/IB02/00244

§ 371 (c)(1),
(2), (4) Date: Jul. 25, 2003

(87) PCT Pub. No.: WO02/060769

PCT Pub. Date: Aug. 8, 2002

(65) Prior Publication Data

US 2004/0074789 A1 Apr. 22, 2004

(30) Foreign Application Priority Data

Feb. 2, 2001 (IT) ..... BO2001A0054

(51) Int. Cl.
*B65D 85/10* (2006.01)

(52) U.S. Cl. ..... 206/273; 206/242; 206/261; 206/268; 229/160.1

(58) Field of Classification Search ..... 206/271, 206/273, 265, 268, 236, 242, 261, 822, 385; D9/423; D27/185, 189, 183, 186; 229/87.12, 229/87.13, 87.14, 107, 160.1, 182.1, 201, 229/4.5, 112; 220/669, 675, 4.25, 4.24, 4.22, 220/23.4, 4.27; 132/318
See application file for complete search history.

(56) References Cited

U.S. PATENT DOCUMENTS

| | | | | | |
|---|---|---|---|---|---|
| 136,984 | A | * | 3/1873 | Felgner | 206/242 |
| 874,337 | A | * | 12/1907 | Helm | 220/844 |
| 2,068,763 | A | * | 1/1937 | Powell | 229/107 |
| 2,326,648 | A | * | 8/1943 | Horr | 312/140.2 |
| 3,278,016 | A | * | 10/1966 | Conti | 206/271 |
| 3,933,299 | A | * | 1/1976 | Shimada et al. | 229/160.1 |

(Continued)

FOREIGN PATENT DOCUMENTS

| | | |
|---|---|---|
| DE | 9308941 | 2/1995 |
| DE | 19730266 | 1/1999 |
| DE | 19741481 | 3/1999 |
| EP | 0764594 | 3/1997 |
| GB | 588741 | 6/1947 |
| GB | 2152905 | 8/1985 |
| WO | 01/44077 | 6/2001 |

*Primary Examiner*—Mickey Yu
*Assistant Examiner*—J. Gregory Pickett
(74) *Attorney, Agent, or Firm*—Timothy J. Klima

(57) ABSTRACT

A pack for tobacco products consists in at least one rigid packet (2) appearing as a container (3) presenting a bottom end face (4), surmounted by a hinged lid (5) presenting a top end face (6) and rotatable between a position in which the packet is open, and a position of interaction with an inner frame (9) anchored to the container (3), in which the packet is closed. The packet (2) presents at least two main faces of which a first face (14) appears flat and a second face (15) is composed of a substantially central flat portion (16) and two curved portions (17) by which the flat portion (16) is connected to the longitudinal edges (18) of the flat first face (14), so that when viewed in cross section the packet (2) presents a substantially semicircular shape, or that of a rounded isosceles trapezoid.

26 Claims, 7 Drawing Sheets

U.S. PATENT DOCUMENTS 4,182,945 A * 1/1980 McArdle et al. ..... 206/385
4,294,353 A * 10/1981 Focke et al. ..... 206/273
D296,938 S * 7/1988 Ameringen ..... D9/423
5,207,322 A * 5/1993 Focke et al. ..... 206/268
5,487,468 A 1/1996 Sheahan
5,823,331 A * 10/1998 Manservigi et al. ..... 206/268
6,168,014 B1 * 1/2001 Manservigi et al. ..... 206/268
6,311,834 B1 11/2001 Focke et al.
6,370,846 B1 4/2002 Schoch et al.
D463,066 S * 9/2002 Draghetti ..... D27/189
6,779,658 B2 * 8/2004 Polloni et al. ..... 206/268

* cited by examiner

PACK OF RIGID TYPE FOR TOBACCO PRODUCTS

This application is the National Phase of International Application PCT/IB02/00244 filed Jan. 25, 2002 which designated the U.S. and that International Application was published under PCT Article 21(2) in English.

1. Technical Field

The present invention relates to a pack of rigid type for tobacco products.

In the following specification, the term pack can be taken generically to mean both a pack comprising at least two packets of cigarettes or serving to contain a plurality of packets of cigarettes, and a single packet containing a group of cigarettes or tobacco products in general.

Generally speaking, conventional packets of the rigid type fashioned with a hinged lid and serving to contain groups of cigarettes will appear usually as a rectangular parallelepiped of substantially rectangular section. In particular, such packets present a bottom end face and a top end face, both flat, and distinct side faces consisting in a flat front face and a flat rear face disposed parallel one with another, and two flat flank faces disposed parallel one with another and at right angles to the front and rear faces.

The packets in question are somewhat awkward to handle and to keep in the pocket of a garment and typically present sharp corner edges, compassing angles of approximately 90°, by which the pocket is forced out of shape and subjected to wear.

2. Background Art

The prior art embraces hinge lid packets of which the corner edges bordering the front and rear faces are rounded or bevelled, a solution that serves to mitigate the drawbacks described above but cannot eliminate them altogether. For example, if a packet is inserted into the pocket of a garment with the rear face directed toward the body of the smoker, the corner edges of the front face, be they sharp or bevelled or rounded, will tend just the same to project forward, forcing the pocket out of shape and subjecting it to wear. This is due to the fact that the flank faces of the packet project forward at right angles to the rear face of the packet.

Even were the angle formed between the planes occupied by the front face and the flank face to be relieved, the relative corner edge would still be somewhat pronounced since, considering the average dimensions presented by a packet of cigarettes, it would form no more than a relatively slender fillet interconnecting two flat faces. Furthermore, the capacity of the packet in this instance would be reduced significantly.

In like manner, given the average dimensions of a packet of cigarettes, the fillet defining a rounded corner edge is typified generally by a relatively small radius of curvature. This makes it necessary to weaken the part of the diecut blank along which the corner edge is formed, by including a plurality of strongly impressed crease lines. When applied in particular to the front corner edges of the packet, these lines are visually unattractive.

DISCLOSURE OF THE INVENTION

The object of the present invention is to provide a pack that will be free of the drawbacks mentioned above.

The stated object is realized in a pack of rigid type for tobacco products according to the present invention comprising at least one rigid packet with a hinged lid, composed of a container presenting a bottom end face and a lid presenting a top end face of which the lid is hinged to the container and able thus to rotate between a position in which the packet is open, and a position of interaction with a frame inserted partly inside the container, in which the packet is closed, characterized in that the packet presents at least two main faces of which a first is flat and a second is composed of a substantially central flat portion and two curved portions by which the flat portion is connected to the longitudinal edges of the flat first face.

The invention will now be described in detail, by way of example, with the aid of the accompanying drawings, in which.

Figure 1:
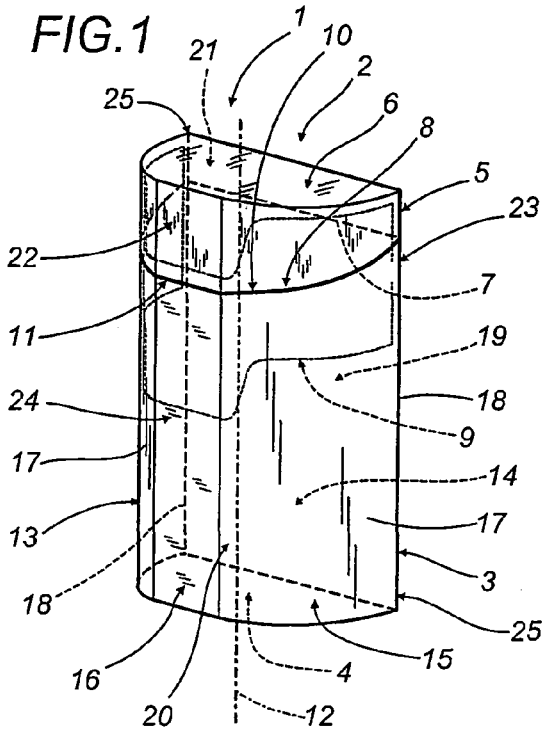
FIGS. 1 to 5 show four embodiments of a pack according to the present invention, consisting in a single packet, illustrated schematically and in perspective.

With reference to FIGS. 1 to 9 of the drawings, 1 denotes a pack of rigid type, in its entirety, and in particular, 2 denotes a rigid packet with a hinged lid serving to contain a group of cigarettes (not indicated) enveloped typically in a respective inner wrapper (likewise not indicated) fashioned from a suitable wrapping material and accommodated inside the packet 2. The single packet 2 comprises a container 3 of which the bottom coincides with the bottom end face 4 of the packet 2, and a lid 5 of which the top coincides with the top end face 6 of the packet 2. The lid 5 is joined hingedly to the container 3 along a line denoted 7 and rotatable thus between an open position (not illustrated), and a closed position in which the lid 5 conceals a top open end 8 of the container 3 and is retained in this same position by a frame 9 located partly inside the container 3 and projecting beyond one edge 10 of the open end 8. In the closed position, this edge 10 is engaged substantially in contact by a free edge 11 of the lid 5. The single packet 2 appears as a prism of which the two bases, lying transverse to an axis 12 coinciding with the axis of the packet 2, are provided respectively by the bottom end face 4 and the top end face 6, and the lateral surface 13 is composed of two main faces identifiable respectively as a flat first face 14 and a second face 15 consisting in a substantially central and flat portion 16 parallel to the first face 14, and two curved portions 17 by which the flat portion 16 is connected to the first face 14 along the longitudinal edges 18 of the selfsame face 14 extending parallel to the aforementioned axis 12.

As discernible from the foregoing and from the position of the hinge line 7, which will be seen to extend transversely across the flat first face 14, the container 3 presents a rear face 19 coinciding with the first face 14 of the prism, and a front face 20 afforded by the flat central portion 16 and the curved portions 17 making up the second face 15 of the prism. In like manner the hinged lid 5, when closed, presents a rear face 21 coinciding with the first face 14 of the prism, and a front face 22 afforded by the flat central portion 16 and the curved portions 17 making up the second face 15 of the prism.

More exactly, the rear face 19 of the container 3 and the rear face 21 of the lid 5 combine to make up the back 23 of the packet 2 coinciding with the flat first face 14, whilst the front face 20 of the container 3 and the front face 22 of the lid 5 make up the front 24 of the packet 2 coinciding with the second main face 15.

Figure 2:
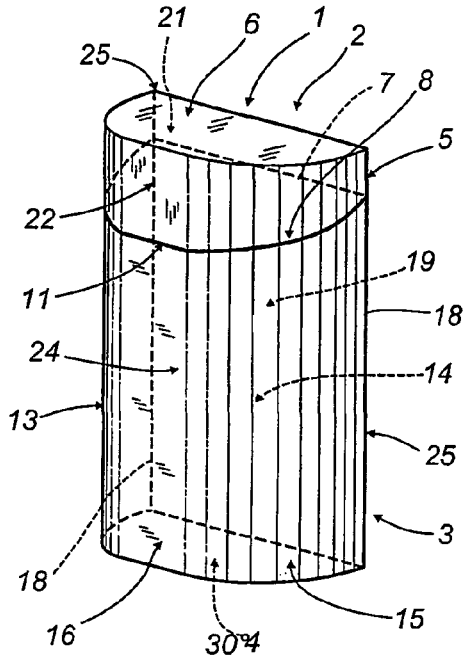
Figure 3:
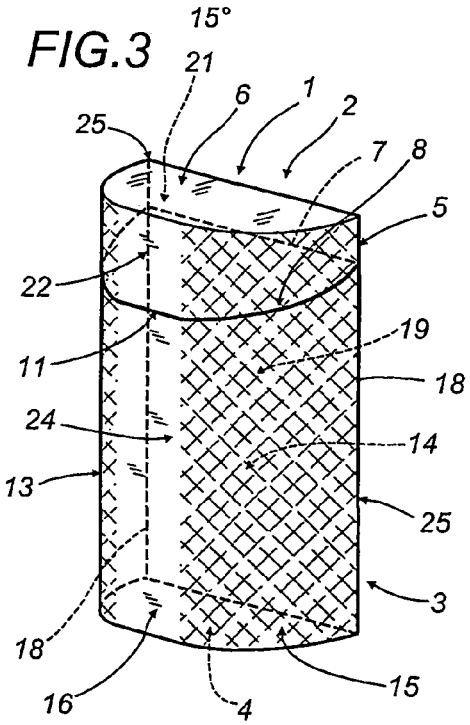
Figure 4:
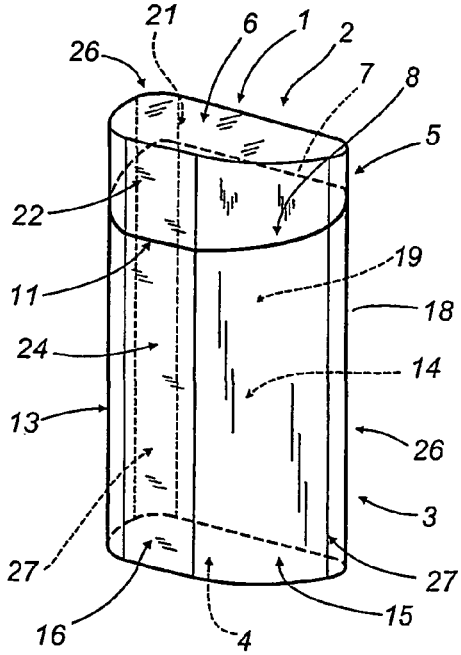
Figure 5:
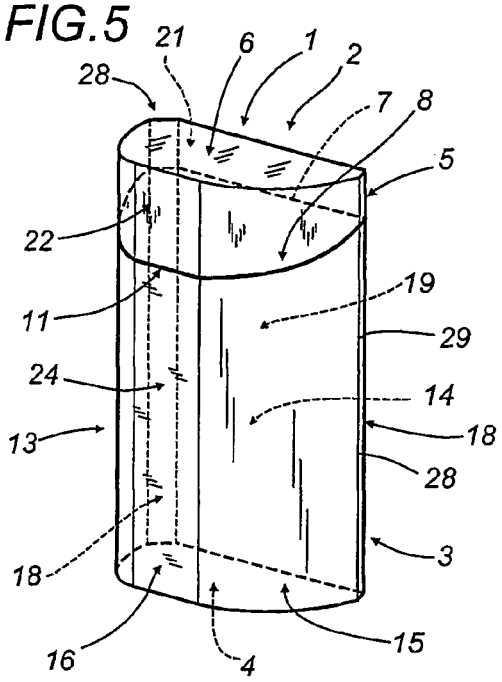

Observing the examples of FIGS. 1, 2 and 3, the relative packet 2 appears with the aforementioned longitudinal edges 18 of the first face 14, along which the curved lateral portions 17 are joined, embodied as sharp corner edges 25, whereas in the example of FIG. 4 the relative packet 2 appears with the selfsame edges 18 embodied as rounded corner edges 26 creating two rounded longitudinal bands 27, and in the example of FIG. 5, the two edges 18 are embodied as bevelled corner edges 28 creating two flat faces 29.

Figure 6:
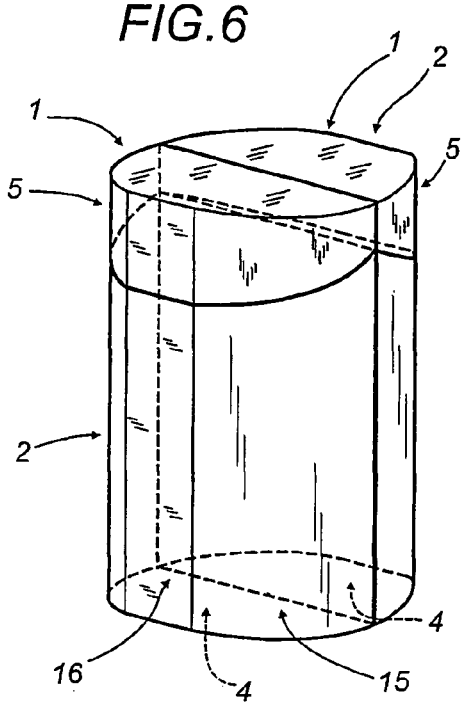
FIGS. 6, 7 and 8 show two embodiments of a pack according to the present invention, consisting in two packets, illustrated schematically and in perspective.
Figure 7:
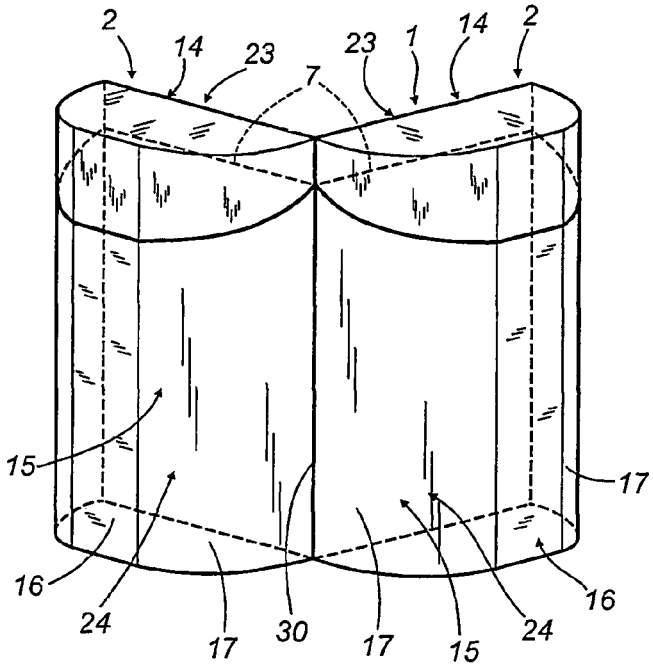
Figure 8:
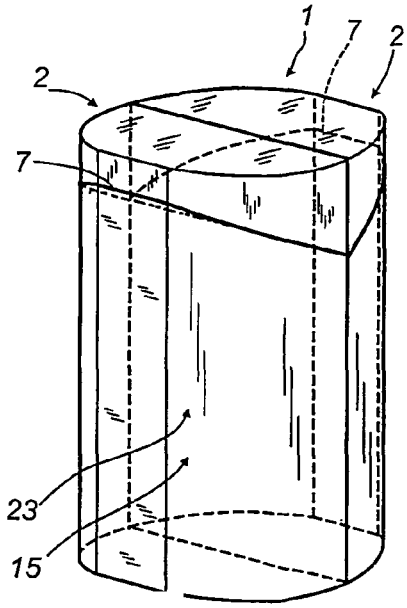

In the example of FIGS. 6, 7 and 8, the pack 1 consists in a pair of packets 2 connected one to another along one common edge 18 that functions as a vertical hinge 30 lying parallel to the axis 12 of each packet 2 and allows the two packets 2 to open out, as illustrated in FIG. 7, or to close up as illustrated in FIGS. 6 and 8 bringing the respective main flat faces 14 into mutual contact.

The vertical hinge 30 can be incorporated as a perforation line that will allow of separating the two packets 2, and in particular separating a part of the hinge 30 that connects the two lids 5, thus enabling each lid 5 to rotate independently about the relative hinge 7 by way of which it is associated with the container 3.

With this in mind, it will be observed that the hinge line 7 in the example of FIG. 8 extends across the flat central portion 16 of the second main face 15 of each individual packet 2, which in this particular instance has the back 23 on the side opposite to that of the packets illustrated in FIGS. 1 to 7, coinciding with the second face 15 rather than with the first face 14.

Figure 9:
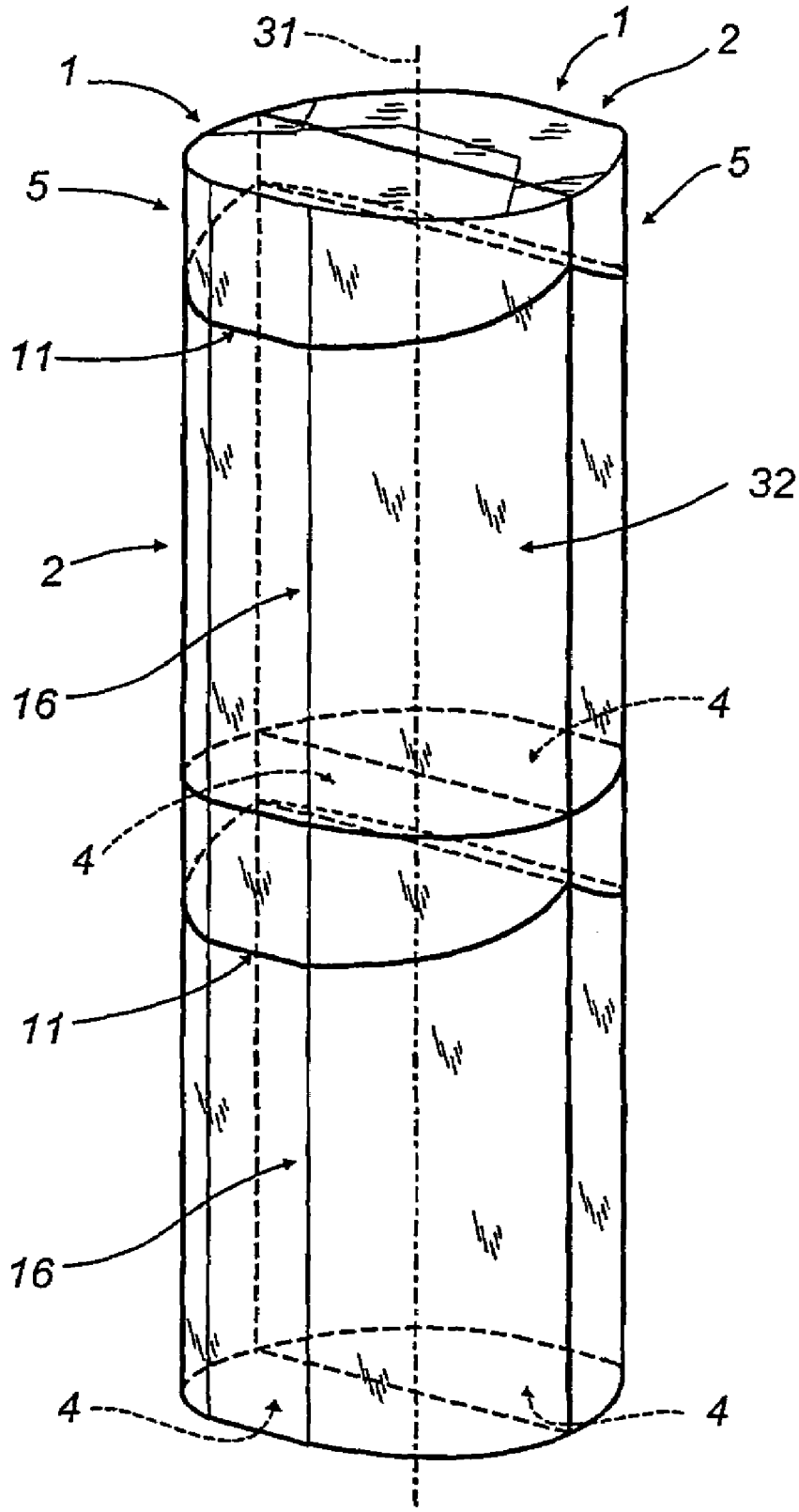
FIG. 9 shows a pack according to the present invention, consisting in a plurality of packets.

As discernible from the illustration of FIG. 9, the pack 1 might comprise a plurality of packets 2 (four in the example shown) stacked in pairs along a common axis 31 and arranged with the two top end faces of one pair of packets 2 offered in contact to the two bottom end faces of the packets 2 next in sequence along the axis 31. In this instance the pack 1 will further comprise a single sheet 32 of wrapping material by which the pairs of packets 2 are enveloped and enclosed.

Figure 10:
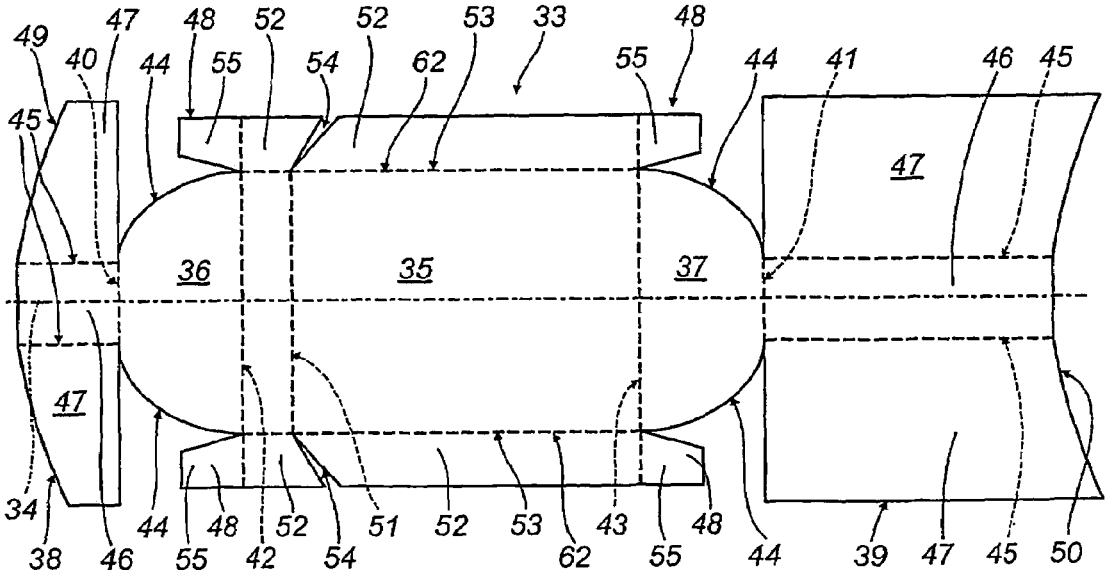
FIGS. 10 to 14 are plan views of diecut blanks used to fashion the packets of FIGS. 1 to 5.

With reference to FIGS. 10 . . . 14, each packet 2 is fashioned from a flat diecut blank 33 of wrapping material, for example cardboard or the like, which will present a substantially elongated rectangular outline, referable to a longitudinal axis 34 lying parallel to the axis 12 of the single packet. The blank 33 presents a plurality of panels aligned on the aforementioned axis 34: a central panel 35, two intermediate panels 36 and 37 and two end panels, one of which denoted 38 associated with the central panel 35 by way of the one intermediate panel 36, the other denoted 39 associated with the central panel 35 by way of the other intermediate panel 37.

The sides of the two intermediate panels 36 and 37 directed toward the respective end panels 38 and 39 present a substantially arcuate profile; more exactly, the first intermediate panel 36 is joined to the relative end panel 38 by way of a respective first rectilinear crease line 40 transverse to the longitudinal axis 34, and the second intermediate panel 37 is joined similarly to the relative end panel 39 by way of a respective first rectilinear crease line 41 parallel to the line 40 mentioned previously.

Similarly, the intermediate panels 36 and 37 are joined to the central panel 35 by way of respective second rectilinear crease lines 42 and 43 disposed transversely to the longitudinal axis 34, parallel with the first crease lines 40 and 41. The second crease line 42 and 43 and the relative first crease line 40 and 41 of each intermediate panel 36 and 37 are interconnected by two segments 44 describing the aforementioned arcuate profile.

The end panels 38 and 39 present respective pairs of longitudinal crease lines 45 extending parallel to the longitudinal axis 34, one on either side. The crease lines 45 in question are separated by a distance substantially equal to the length of the aforementioned first rectilinear crease lines 40 and 41 and serve accordingly to define a respective longitudinal central area 46 on each end panel 38 and 39, of width identical to the length of the first crease lines 40 and 41, and two longitudinal lateral portions 47 extending parallel to the central area 46, which, following the erection of the packet 2, will be matched to the aforementioned segments 44 of the intermediate panels 36 and 37 and held in position relative to these same panels by means of retaining flaps denoted 48.

In particular, the two central areas 46 combine to establish the flat central portion 16 presented by the second face 15 of the packet 2, whilst the two longitudinal lateral portions 47 combine to create the two curved portions 17 interconnecting the flat portion 16 and the longitudinal edges 18 of the flat first face 14, which in turn coincides with the central panel 35 of the blank.

With this in mind, it will be noted that the end panels 38 and 39 are embodied with respective free edges 49 and 50 of substantially arcuate profile, and that in the erected packet 2 these same edges will coincide with the aforementioned free edge 11 of the lid 5 and the free edge 10 of the top open end 8 afforded by the container 3.

The central panel 35 further presents a crease line 51 extending transversely to the longitudinal axis 34 and coinciding with the hinge line 7, and is flanked longitudinally by lateral connecting panels 52 joined to the selfsame central panel 35 by way of relative longitudinal precreased areas 53 extending parallel to the longitudinal axis 34 and divided into two parts by respective notches 54 converging on the ends of the crease line 51.

Figure 13:
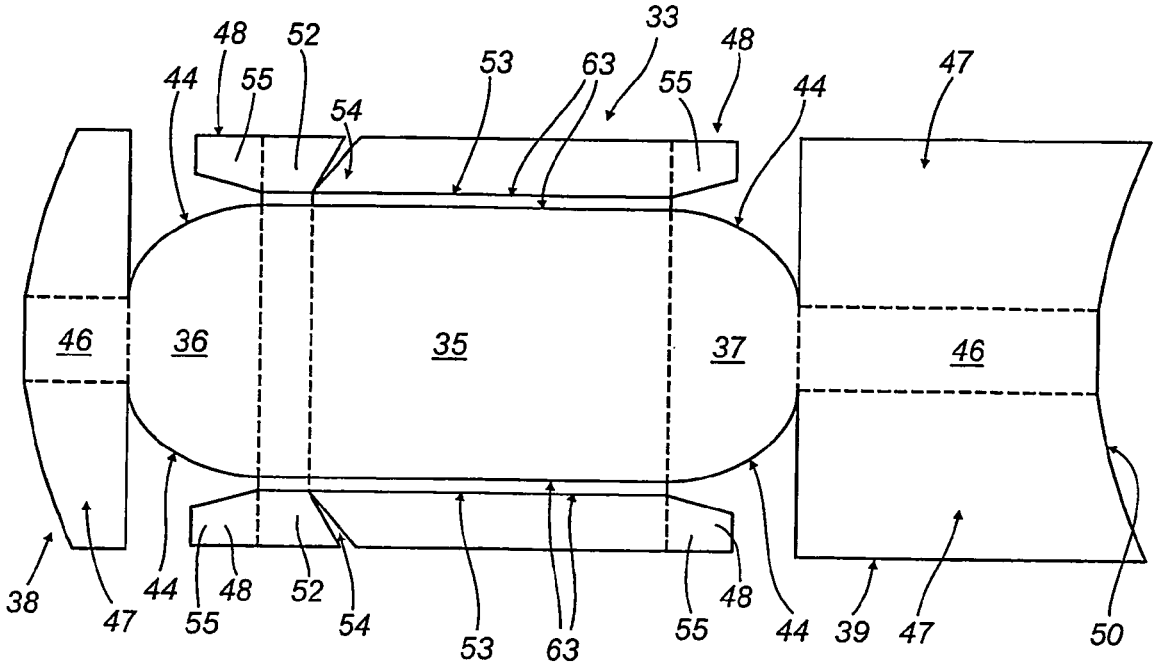
Figure 14:
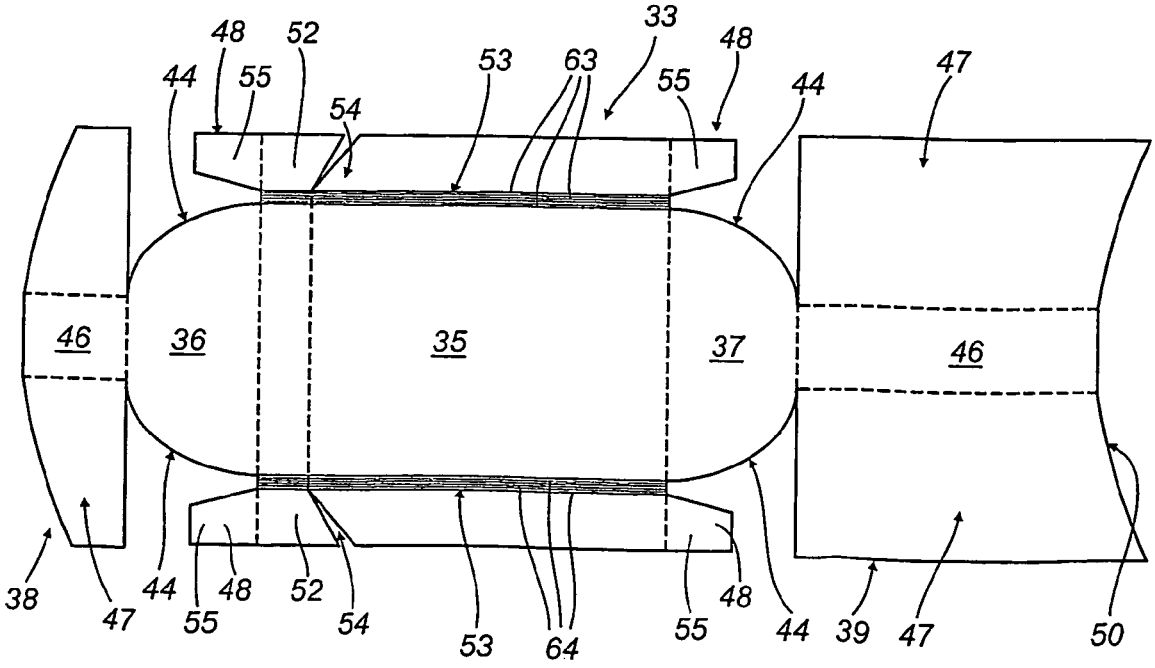

In the examples of FIGS. 10, 13 and 14, the retaining flaps 48 consist in respective enclosing flaps 55 afforded by the opposite longitudinal ends of the lateral panels 52 and positioned to engage the respective intermediate panels 36 and 37.

Figure 11:
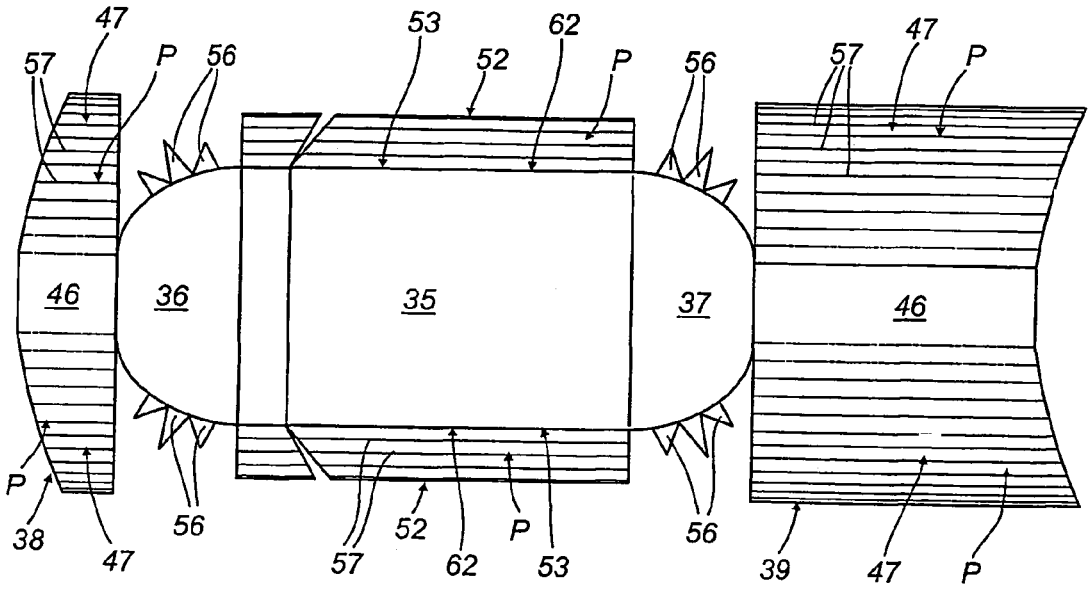
Figure 12:
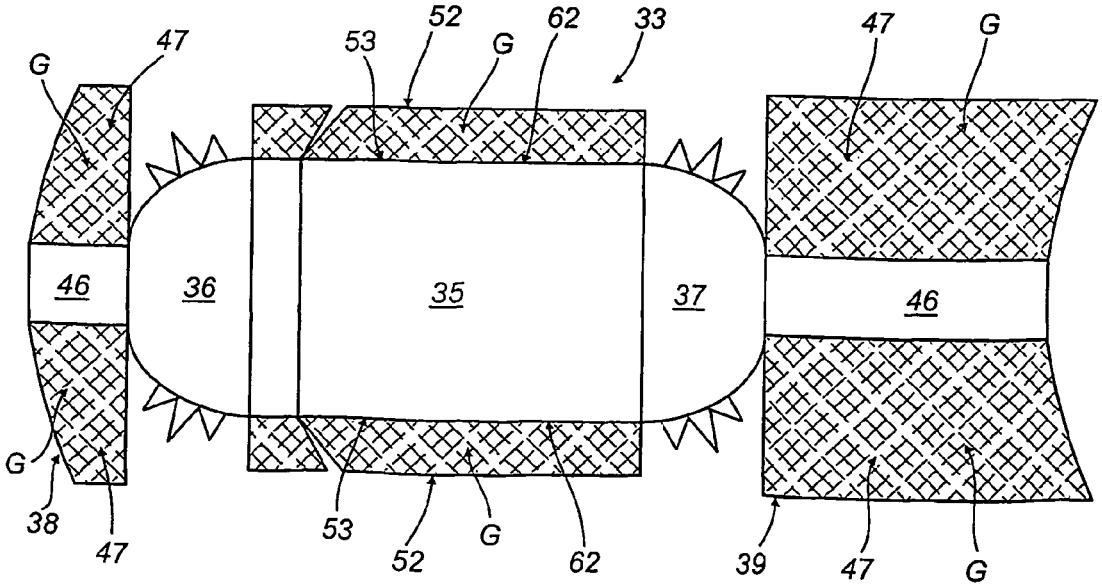

In the example of FIGS. 11 and 12 the retaining flaps 48 consist in radial flaps 56 afforded by the arcuate segments 44 of the intermediate panels 36 and 37 and positioned to engage the corresponding lateral portions 47 of each end panel 38 and 39.

More exactly, the intermediate panels 36 and 37 are destined respectively to establish the top end face 6 and the bottom end face 4 of an erected packet 2 that can present a section identifiable substantially as semicircular, or, as a rounded isosceles trapezoid of which the greater base is defined by the intersection of a sectional plane with the flat first face 14, coinciding with the second crease lines 42 and 43 in the case of the end faces, and the smaller base is defined by the intersection of a sectional plane with the flat portion 16 of the second face 15, coinciding with the first crease lines 40 and 41 in the case of the end faces.

Observing a packet 2 that appears substantially semicircular in section, the aforementioned curved portions 17 and arcuate segments 44 will describe an arc to a circle.

In the examples of FIGS. 11 and 12, unlike the examples of FIGS. 10, 13 and 14, the longitudinal lateral portions 47 of the end panels 38 and 39 and the lateral connecting panels 52 associated with the central panel 35 are rendered pliable, visibly, so as to bend readily when the packet 2 is erected and adapt to the profile of the arcuate segments 44 presented by the intermediate panels 36 and 37.

In the example of FIG. 12, the longitudinal lateral portions 47 and the connecting panels 52 are rendered pliable by an embossing operation denoted G.

In the example of FIG. 11, the longitudinal lateral portions 47 and the connecting panels 52 are rendered pliable by the impression, denoted P, of a plurality of crease lines 57.

It will be noted that the separation between the lateral portions 47 and the central area 46 is not represented by a distinct line of demarcation and that the selfsame lateral portions 47 and central area 46 are joined with no break in continuity, so that the flat central portion 16 and the two curved lateral portions 17 of the second main face 15, which coincides with the front 24 of the packet 2, will merge without any prominent sharp corner edges being generated.

Figure 15:
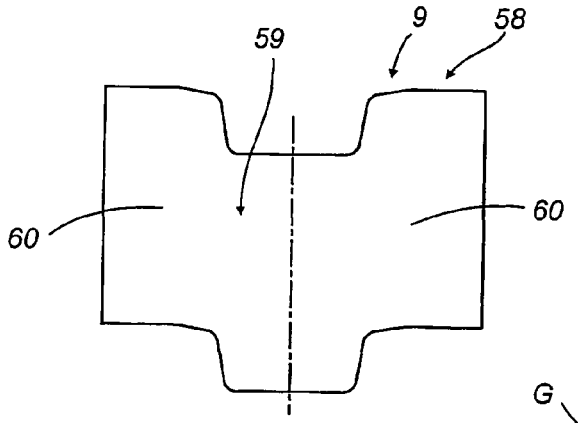
FIGS. 15 to 17 are plan views of diecut blanks used to fashion frames for the packets illustrated in FIGS. 1 to 3.
Figure 16:
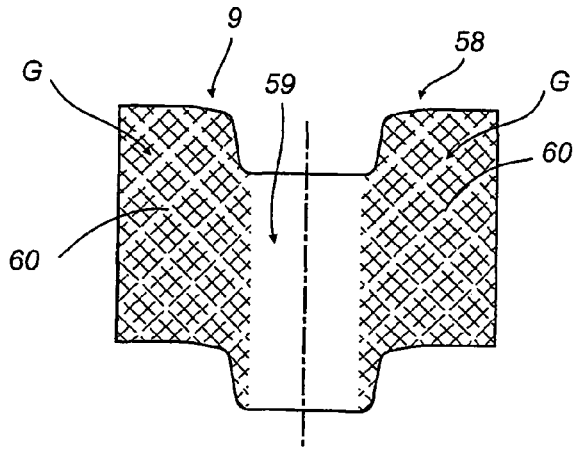
Figure 17:
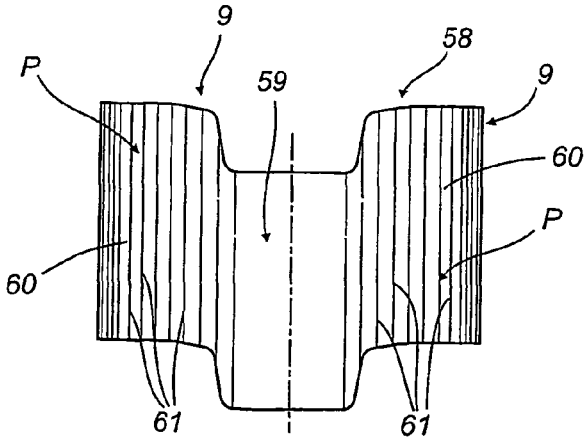

In the same manner as described for the blanks 33 relative to the packet 2, the blanks 58 from which to fashion the frames 9 illustrated in FIGS. 15, 16 and 17 present a longitudinal central area 59 that will be offered to the central areas 46 of the end panels 38 and 39, and two longitudinal lateral bands 60 that will be offered to the longitudinal lateral portions 47 of the selfsame panels 38 and 39. In particular, with reference to the example of FIG. 16, the lateral longitudinal bands 60 are rendered pliable by an embossing operation similar to that performed on the corresponding portions 47 of the packet blank 33 of FIG. 12, and denoted G likewise in the case of the frame 9. In the example of FIG. 17, the longitudinal lateral bands 60 are rendered pliable by the impression P of a plurality of crease lines 61 similar to those presented by the portions 47 of the packet blank 33 illustrated in FIG. 11.

Likewise in the case of the blanks 58 from which the frames 9 are fashioned, the separation between the lateral bands 60 and the central area 59 is not represented by a distinct line of demarcation, the bands and the central area merging with no break in continuity in such a way as to breast neatly with the inside face of the packet 2.

Finally, it will be seen that in the case of the blanks 33 illustrated in FIGS. 10, 11 and 12 and the corresponding packets 2 of FIGS. 1, 2 and 3, the precreased areas 53 consist in single crease lines 62 that will generate sharp corner edges when the packet is erected.

In the case of the blank 33 shown in FIG. 13 and the corresponding packet 2 of FIG. 5, each precreased area 53 consists in a pair of mutually parallel crease lines 63 separated one from another by a predetermined distance, such as will generate the aforementioned flat face 29 of a bevelled corner edge 28 when the packet is erected.

In the case of the blank 33 shown in FIG. 14 and the corresponding packet 2 of FIG. 4, each precreased area 53 consists in a plurality of mutually parallel crease lines 64, such as will generate the aforementioned rounded face 27 of a rounded corner edge 26 when the packet is erected.

The invention claimed is:

1. A pack of rigid type for tobacco products, comprising at least one rigid packet with a hinged lid, composed of a container presenting a bottom end face and a lid presenting a top end face, the lid being hinged to the container and able thus to rotate between a position in which the packet is open, and a position of interaction with a frame inserted partly inside the container, in which the packet is closed, the packet presents two main faces of which a first back face is flat and a second front face is composed of a substantially central flat portion and two curved portions, lying on the same arc of a circle, by which the flat portion is directly connected to the longitudinal edges of the flat first face and in which the second front face is completely visible in a planar view.

2. A pack as in claim 1, wherein the packet appears in cross section as a rounded isosceles trapezoid of which the greater base is defined by the flat first face and the smaller base is defined by the flat portion of the second face.

3. A pack as in claim 1, wherein at least one of the longitudinal edges of the flat first face appears as a sharp corner edge.

4. A pack as in claim 1, wherein at least one of the longitudinal edges of the flat first face appears as a bevelled corner edge.

5. A pack as in claim 1, wherein at least one of the longitudinal edges of the flat first face appears as a rounded corner edge.

6. A pack as in claim 1, wherein the lid is joined hingedly to the container along a hinge line extending transversely across the first main face.

7. A pack as in claim 1, wherein the lid is joined hingedly to the container along a hinge line extending transversely across the flat central portion of the second main face.

8. A pack as in claim 1, comprising a pair of packets joined one to another along one of the two longitudinal edges of the first main face.

9. A pack as in claim 1, comprising a plurality of pairs of packets stacked along a common axis, arranged with the bottom end faces and the top end faces in mutual contact and enveloped in a single sheet of wrapping material.

10. A pack as in claim 1, wherein the single packet is fashioned from a diecut blank presenting a substantially elongated rectangular outline, referable to a longitudinal axis lying parallel to the longitudinal axis of the relative pack and presenting, aligned on the axis, a central panel, two intermediate panels and two end panels, of which the intermediate panels appear each with the side directed toward the respective end panel presenting a substantially arcuate profile and are joined each to the respective end panel by way of a relative rectilinear crease line disposed transversely to the longitudinal axis.

11. A pack as in claim 10, wherein each intermediate panel is joined to the central panel by way of a respective second rectilinear crease line disposed transversely to the longitudinal axis and connected to the corresponding first crease line by two segments describing an arc to a circle that defines the arcuate profile.

12. A pack as in claim 10, wherein the end panels present two respective longitudinal crease lines extending parallel to the longitudinal axis, one on either side, combining to delimit an internal area coinciding with the flat central portion presented by the second main face of the packet, and external areas appearing as two longitudinal lateral portions coinciding with the curved portions interconnecting the flat portion and the longitudinal edges of the flat first main face generated by the central panel.

13. A pack as in claim 12, wherein the free transverse edges of the end panels present a substantially arcuate profile.

14. A pack as in claim 10, wherein the central panel presents a crease line extending transversely to the longitudinal axis and serving to establish the hinge line, and is flanked laterally by two longitudinally disposed connecting panels joined to the selfsame central panel along respective longitudinal precreased areas and divided into two parts by respective notches converging on the ends of the hinge crease line.

15. A pack as in claim 14, wherein each lateral connecting panel presents retaining flaps at the opposite ends, positioned to engage the respective intermediate panels.

16. A pack as in claim 10, wherein each of the arcuate segments afforded by the intermediate panels is furnished with at least one radial flap positioned to engage the corresponding lateral portion of the relative end panel.

17. A pack as in claim 10, wherein the lateral portions of each end panel and the connecting panels associated laterally with the central panel are rendered pliable and adaptable thus to the curvature of the arcuate profile.

18. A pack as in claim 17, wherein the pliability enabling adaptability to the arcuate curvature is obtained by an embossing operation.

19. A pack as in claim 17, wherein the pliability enabling adaptability to the arcuate curvature is obtained by the impression of a plurality of longitudinal crease lines.

20. A pack as in claim 14, wherein the longitudinal precreased areas consist in at least one crease line.

21. A pack as in claim 14, wherein the longitudinal precreased areas consist in at least two mutually parallel crease lines separated by a first predetermined distance.

22. A pack as in claim 14, wherein the longitudinal precreased areas consist in a plurality of mutually parallel crease lines separated by a second predetermined distance.

23. A pack as in claim 10, wherein the frame is fashioned from a respective flat diecut blank presenting a central area offered to the central area of the end panels, and two respective lateral bands offered to the longitudinal lateral portions of the selfsame panels.

24. A pack as in claim 23, wherein the lateral bands em rendered pliable and adaptable thus to the curvature presented by the arcuate segments of the intermediate panels of the packet blank.

25. A pack as in claim 23, wherein the pliability enabling to the arcuate curvature is obtained by an embossing operation.

26. A pack as in claim 23, wherein the pliability enabling adaptability to the arcuate curvature is obtained by impressing a plurality of longitudinal crease lines.

* * * * *